US006936022B1

(12) United States Patent
Root

(10) Patent No.: US 6,936,022 B1
(45) Date of Patent: Aug. 30, 2005

(54) ADJUSTABLE PAD FOR SUPPORTING HANDS AND ARMS

(76) Inventor: Warren N. Root, 24921 Muirlands, Unit 112, Lake Forest, CA (US) 92630

( * ) Notice: Subject to any disclaimer, the term of this patent is extended or adjusted under 35 U.S.C. 154(b) by 0 days.

(21) Appl. No.: 10/761,785

(22) Filed: Jan. 21, 2004

Related U.S. Application Data

(60) Provisional application No. 60/442,613, filed on Jan. 23, 2003.

(51) Int. Cl.[7] ..... A61F 13/00
(52) U.S. Cl. ..... 602/21; 602/20; 248/118; 248/118.3; 248/118.5
(58) Field of Search ..... 602/21; 400/715; 84/469, 328, 465, 467, 468; 601/40; 248/118, 248/118.3, 118.5

(56) References Cited

U.S. PATENT DOCUMENTS

| | | | | |
|---|---|---|---|---|
| 591,800 A | | 10/1897 | Finnblade et al. | 84/468 |
| 679,288 A | | 7/1901 | Bohrer | 84/468 |
| 3,782,719 A | | 1/1974 | Kuhlman | 84/468 X |
| 5,082,258 A | | 1/1992 | Niks | 84/467 X |
| 5,158,256 A | * | 10/1992 | Gross | 248/118.3 |
| 5,398,896 A | * | 3/1995 | Terbrack | 248/118.5 |
| 5,876,362 A | | 3/1999 | Root | 602/21 |
| 6,217,587 B1 | | 4/2001 | Tsuruta | 602/21 |
| 2001/0009263 A1 | * | 7/2001 | Chou | 248/118 |

* cited by examiner

*Primary Examiner*—Kim M. Lewis
(74) *Attorney, Agent, or Firm*—Jerry Turner Sewell

(57) ABSTRACT

A system and method support the forearms, wrists and hands of a user performing repetitive tasks. A support pad has a low-friction upper surface. A cradle is attached to each of the user's wrists. A first portion of a cradle supports the lower portion of the forearm, including the wrist, when the first portion rests upon the upper surface of the support pad. A second portion of each cradle supports the hand of the user. A retaining device attaches the cradle to the lower forearm. The low-friction upper surface advantageously comprises neoprene material (e.g., wetsuit material). The system and method reduce strains on the arms and shoulders of the user by supporting the user's arms and hands while the user performs the repetitive tasks.

9 Claims, 5 Drawing Sheets

ADJUSTABLE PAD FOR SUPPORTING HANDS AND ARMS

RELATED APPLICATIONS

The present application claims the benefit of priority under 35 U.S.C. § 119(e) of U.S. Provisional Application No. 60/442,613, filed on Jan. 23, 2003.

BACKGROUND OF THE INVENTION

1. Field of the Invention

The present invention is in the field of devices that provide support to the lower arm, wrists and hands during the performance of repetitive tasks, such as typing and data entry.

2. Description of the Related Art

Many personal and job-related tasks involve the use of computer keyboards, calculators and other data entry devices, which require a person to have his or her arms and hands extended in front of the person's body for long durations. In addition, other tasks, such as assembly work, sewing, needlework, knitting, painting, or the like, require the arms and hands to be likewise extended.

As a result of repeated periods of arm and hand extension, many persons have developed injuries such as carpal tunnel syndrome. In addition, because of aging, accidents, or certain diseases, some persons no longer have the ability to perform relatively simple tasks which require arm and hand extension.

A number of devices have been developed to reduce the effects of such extension. For example, wrist pads are available to place in front of a keyboard to elevate the wrists and thereby change the angle of the hands with respect to the keyboard. Such wrist pads do not however assist the user when the user has to move his or her hands from side-to-side on the keyboard. In particular, if a person has weak muscles or the like, the person may be unable to move freely about the keyboard. Thus, additional assistance for using keyboards and for performing other tasks requiring arm and hand extension is desirable.

Earlier solutions for providing support for a person's hands and arms are illustrated in U.S. Pat. Nos. 5,876,362 and 6,217,537 issued to Warren N. Root, which are incorporated by reference herein.

SUMMARY OF THE INVENTION

One aspect of embodiments in accordance with the present invention is a system for supporting the forearms and hands of a user performing repetitive tasks. The system includes a support pad having a low-friction upper surface. The system also includes first and second cradles to attach to the arms of the user. Each cradle includes a first portion to support the lower portion of the forearm of a user when the first portion rests upon the upper surface of the support pad. A second portion of each cradle supports the hand of the user. A retaining device attaches the cradle to the lower forearm of the user. Preferably, the low-friction upper surface comprises neoprene material such as, for example, wetsuit material. In preferred embodiments, the height of the upper surface with respect to a bottom surface is adjustable. For example, the height is adjustable by rotating at least one wheel threaded onto a stud.

In certain embodiments of the cradle, the retaining device comprises a bracelet fixed to the first portion. In other embodiments, the retaining device comprises a hook and pile fastening system. In preferred embodiments of the cradle, the second portion includes a raised portion positioned to engage the palm of a user.

Another aspect of embodiments in accordance with the present invention is a method for reducing strains on the arms and shoulders of a user performing repetitive tasks such as typing and data entry. The method includes positioning a support pad proximate a keyboard and generally in parallel to the front edge of the keyboard. The support pad has an upper surface comprising a low-friction material. The method further includes placing a cradle on each of the user's lower forearms and hands. The cradle has a forearm support portion and a hand support portion. The method further includes positioning the forearm support portion of each cradle on the upper surface of the support pad with the hand support portion directed toward the keyboard. When positioned in accordance with the method, the cradles support the user's arms and hands while the user performs the repetitive tasks.

BRIEF DESCRIPTION OF THE DRAWINGS

Embodiments in accordance with the present invention are described below in connection with the accompanying drawing figures in which.

DETAILED DESCRIPTION OF THE PREFERRED EMBODIMENT

Figure 1:
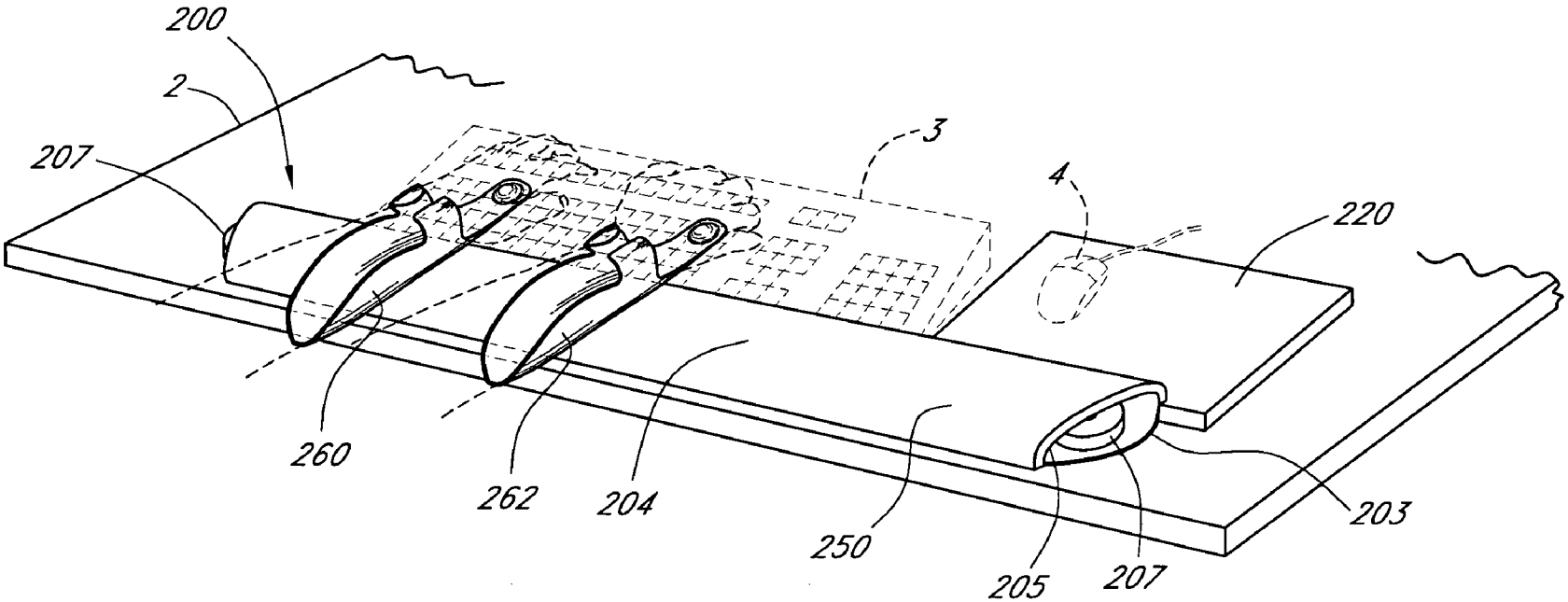
FIG. 1 illustrates a perspective view of the cradles, the adjustable pad and the mouse pad of the adjustable pad assembly, and further illustrates (in phantom) the position of a keyboard, a pointing device (mouse) and a user's hands with respect to the cradles, the adjustable pad and the support platform.

As shown in FIG. 1, an adjustable pad assembly 200 rests on a generally horizontal supporting surface 2 proximate to a keyboard 3 and a pointing device (e.g., a mouse) 4. The supporting surface 2 may advantageously be the upper surface of a desk, a workstation, a table, or the like. The supporting surface 2 may also advantageously be the upper surface of a fixed or adjustable keyboard tray attached to a desk or workstation.

The adjustable pad assembly 200 comprises a generally horizontal wrist support pad 204. The support pad 204 has a length (parallel to a front edge of the supporting surface 2)

of approximately 24 inches. The support pad 204 has a width (or depth) from a front edge (proximate the edge of the supporting surface) to a rear edge (proximate the keyboard 3) of approximately 3 inches. As discussed below, the height of the wrist support pad 204 is adjustable. In one advantageous embodiment, the height is adjustable from approximately 1 inch to approximately 1.25 inches.

The support pad 204 comprises a base portion 203 and an upper portion 205. In the embodiment illustrated in FIG. 2A, the base portion 203 and the upper portion 205 are formed from a single (e.g., unitary) sheet of material, such as, for example, aluminum, plastic, or the like. The sheet of material is bent into a generally "U"-shaped form so that the upper portion 205 is generally parallel to the base portion 203. In the illustrated embodiments, the "bottom" of the "U" forms the rear edge of the support pad 204 and the two ends of the "U" are proximate the front edge of the support pad 204. In preferred embodiments illustrated herein, the two ends have respective flanges formed thereon to increase the rigidity of the upper portion 205 and the base portion 203.

The base portion 203 is generally planar (e.g., flat) so that the base portion 203 rests evenly on the supporting surface 2. In preferred embodiments, at least a portion of the bottom of the base portion 203 is coated with a conventional non-skid material so that the pad assembly 200 generally remains in one position on the supporting surface 2 unless deliberately moved by a user.

Figure 2A:
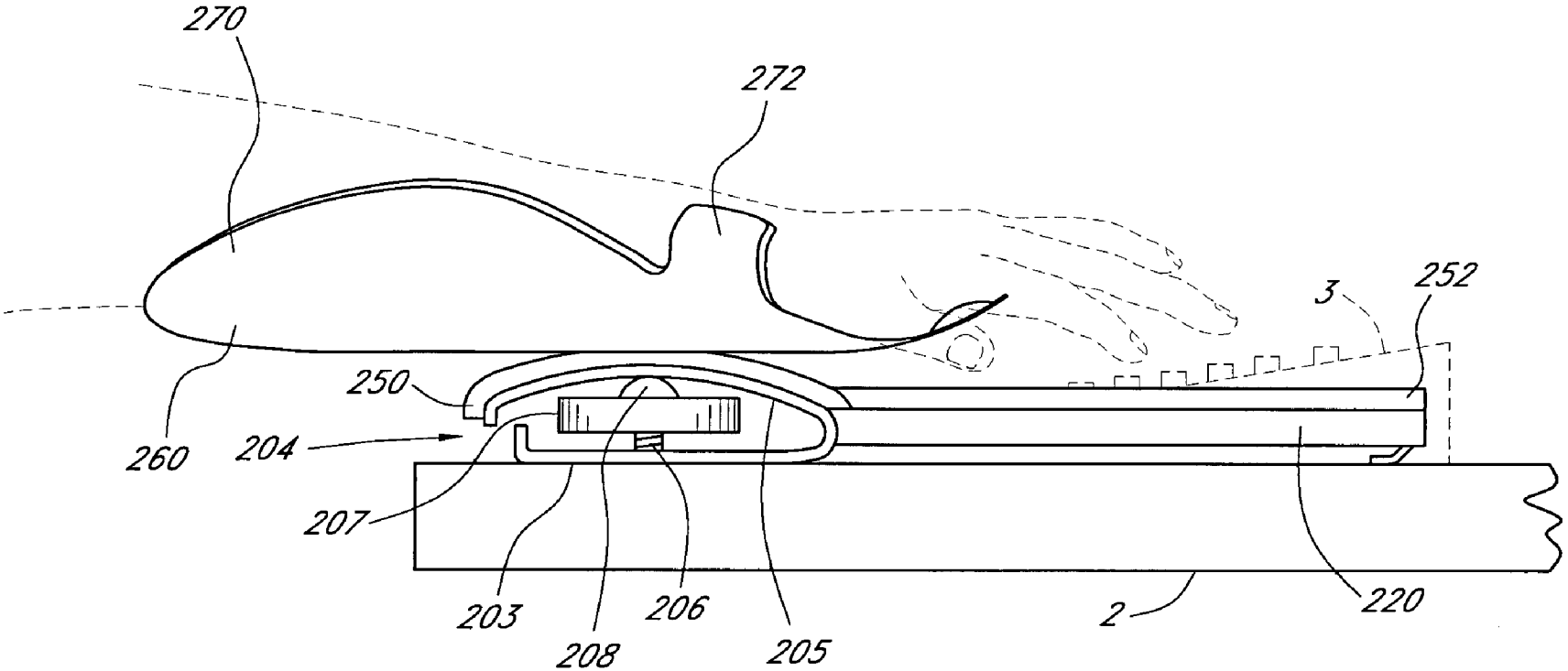
FIG. 2A illustrates an end view of the adjustable pad assembly of FIG. 1 for an embodiment of the adjustable pad having a unitary base portion and upper portion, and further illustrates an embodiment of a wrist cradle positioned on the adjustable pad.

As illustrated in FIG. 2A, the upper portion 205 preferably has a convex cross section taken across the upper portion 205 in the direction of the width of the pad assembly 200 so that the top surface of the upper portion 205 is curved. In particular, the height of the exposed surface of the upper portion increases from the front edge of the exposed surface to a location approximately in the middle of the exposed surface. The height of the exposed surface decreases from the approximate middle of the exposed surface to the rear edge of the exposed surface.

The convex cross section of the upper portion 205 may be considered to be more aesthetically pleasing to some users. In addition, the contour of the upper portion 205 is beneficial to the smooth operation of the pad assembly 200, as will be discussed in more detail below.

In the embodiment of FIG. 2A, the support pad 204 comprises a deformable material that can be shaped as shown in FIG. 2A. After being shaped as shown, the material has "memory" so that when the material is flexed in response to an applied force, the material returns to the original shape when the force is removed. In particular, when an upward force is applied to the upper portion 205, the front edge of the upper portion moves upward away from the front edge of the base portion 203. The upper portion 205 returns to the original position when the force is removed.

In FIGS. 1 and 2A, the force to selectively displace the upper portion 205 is applied by first and second height-adjustment wheels 207. The first wheel 207 is positioned proximate a first end (left end in FIG. 1) of the base portion 203 and the upper portion 205. A second wheel 207 is positioned proximate a second end (right end in FIG. 1) of the base portion 203 and the upper portion 205. As shown in FIG. 2A, each wheel 207 is threaded onto the upper end of a threaded stud 206. The stud 206 is oriented vertically with respect to the base portion 203 and has a lower end secured to the base portion 203.

Preferably, the wheel 207 has a cap 208 that engages the inside surface of the upper portion 205 at approximately the middle of the upper portion 205 (e.g., where the inner surface of the upper portion 205 is displaced by the farthest distance from the lower portion 203). In preferred embodiments, the cap 208 is formed with a low-friction surface so that rotation of the wheel 207 is not significantly inhibited by friction between the cap 208 and the inner surface of the upper portion 205.

Rotation of the wheel 207 causes the wheel 207 to move up or down with respect to the stud 206. For example, the wheel 207 is at a uppermost position when the threads of the wheel 207 engage a small number of threads at the top of the stud 206. The wheel 207 reaches a lowermost position when the top of the stud 206 engages an inside surface (not shown) of the cap 208. The thickness of the wheel 207 is advantageously selected to enable the wheel to travel approximately 0.25 inch.

As the wheel 207 is rotated in a first direction (e.g., counterclockwise looking down at the cap 208), the cap 208 will displace the exposed surface of upper portion 205 farther away from the base portion 203, thus increasing the height of the adjustable pad 204 with respect to the supporting surface 2. As the wheel 207 is rotated in a second direction (e.g., clockwise), the "memory" of the elastic material returns the material to the original shape to reduce the displacement of the upper portion 205, thus decreasing the height of the exposed surface of the upper portion 205. A user rotates the wheels 207 to select a desired height for the exposed surface of the upper portion 205.

As discussed above, the cap 208 engages the upper portion 205 at approximately the middle of the upper portion 205 where the distance between base portion 203 and the upper portion 205 is the greatest. Thus, adjustment of the wheels 207 effectively adjusts the highest point of the upper portion. The locations of the studs 206 could be moved toward the rear edge of the adjustable pad 204 so that the vertical movement of the wheels 207 causes a greater vertical movement of the upper portion 205.

Figure 2B:
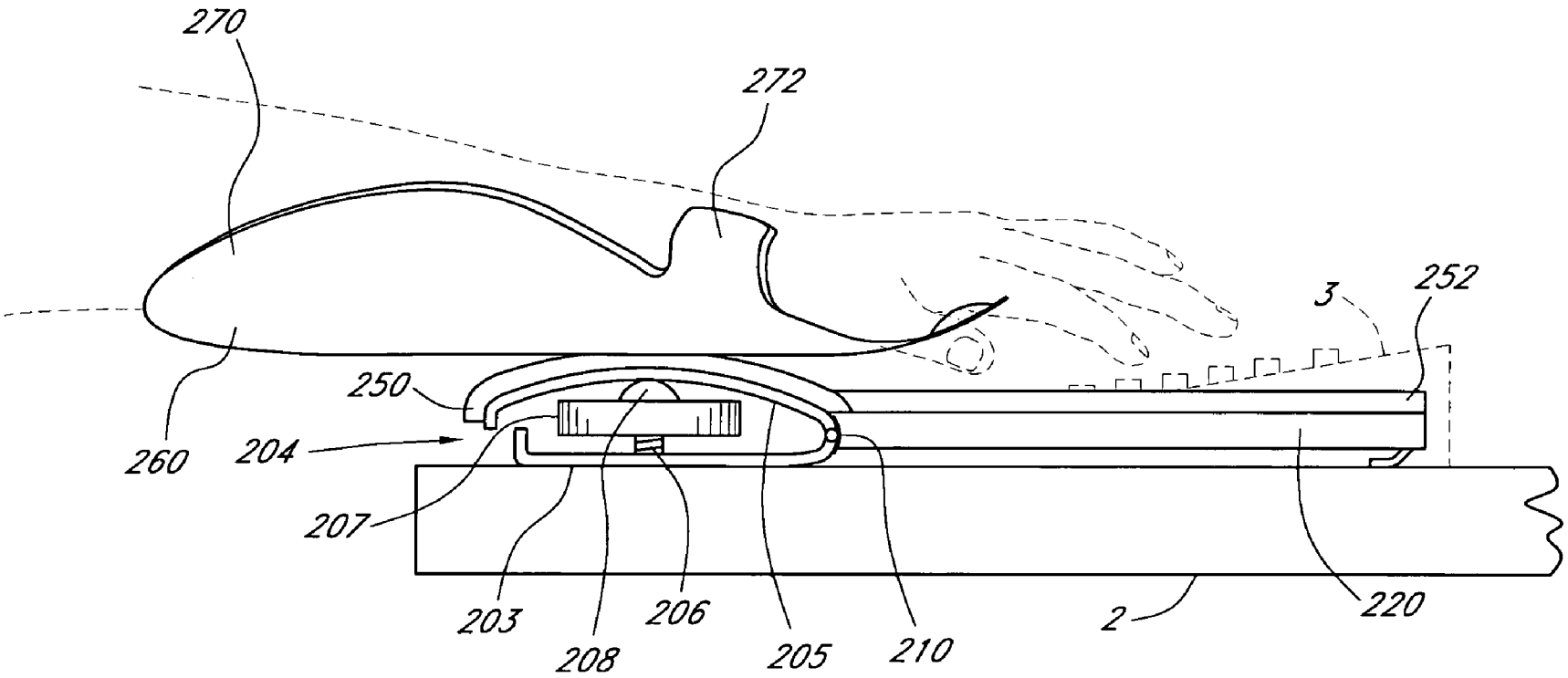
FIG. 2B illustrates an end view of the adjustable pad assembly of FIG. 1 for an alternative embodiment of the adjustable pad having an upper portion pivotably coupled to a base portion by a hinge.

In another embodiment illustrated in FIG. 2B, the base portion 203 and the upper portion 205 are formed separately and are pivotably coupled at the rear edge of the adjustable pad 204 by a hinge 210. For example, the hinge 210 advantageously comprises a piano hinge that extends substantially the entire length of the adjustable pad 204. Alternatively the hinge 210 may advantageously comprise a plurality of shorter hinges or other pivotal coupling devices.

The embodiment of FIG. 2B advantageously eliminates the acute bend required at the read edge of the adjustable 204 in FIG. 2A. The embodiment of FIG. 2B may also comprise different materials for the upper portion 205 and the base portion 203. The embodiment of FIG. 2B also allows the upper portion 205 to be displaced further from the base portion 203 such that the inner surface of base portion 203 may be used for storing small items (e.g., pencils, pens, paper clips, stick-on note pads, etc.).

The embodiment of FIG. 2B operates in substantially the same manner as the embodiment of FIG. 2A in response to the rotation of the adjustment wheels 207; however, unlike the embodiment of FIG. 2A, the embodiment of FIG. 2B relies on gravity, rather than the elasticity of the material, to lower the upper portion 205 when the wheels 207 are lowered. Thus, the material used to form the upper portion 205 and the lower portion 203 may be a rigid material.

Figure 5:
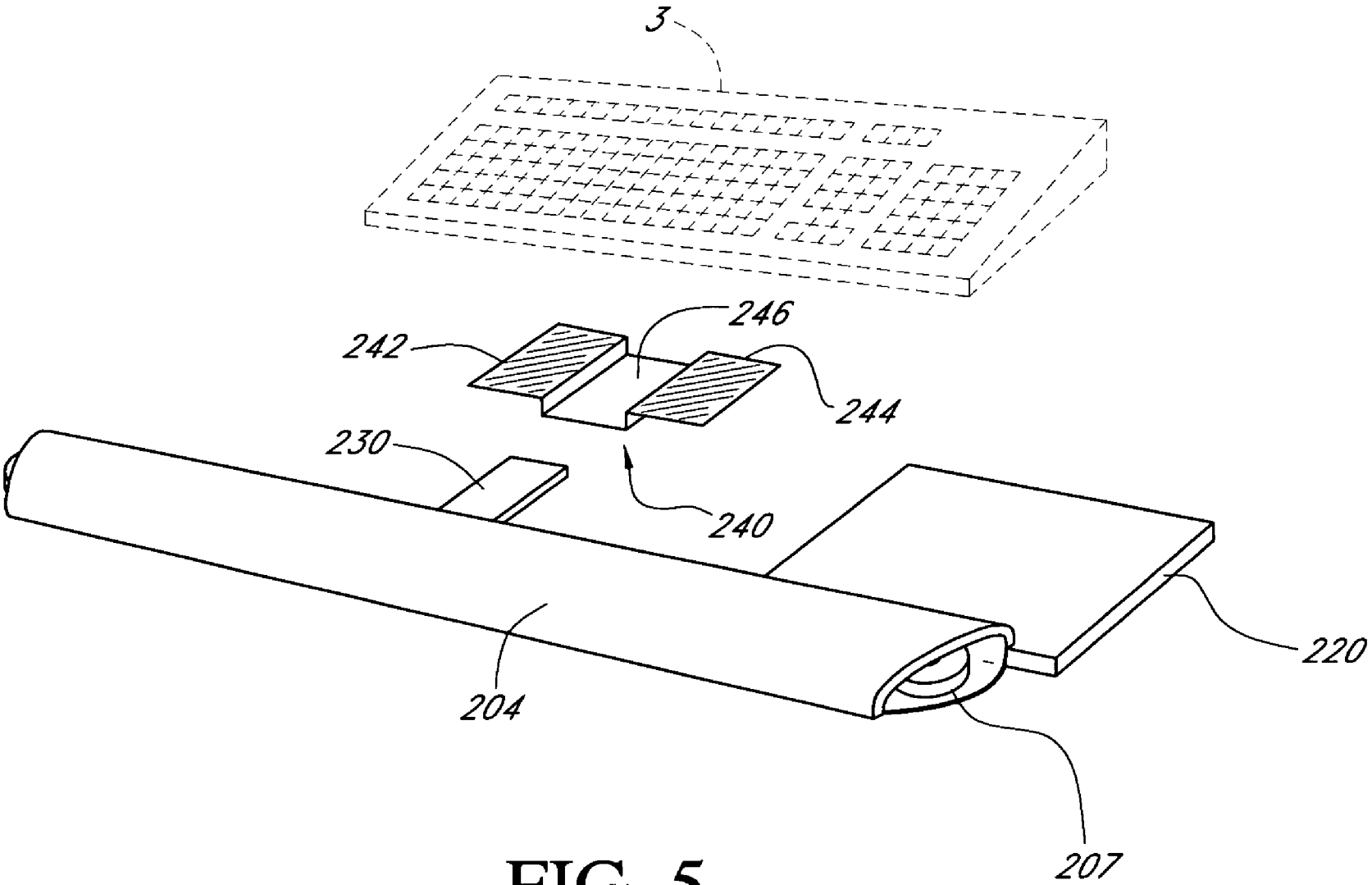
FIG. 5 illustrates an embodiment of the adjustable pad that further includes an apparatus for positioning the keyboard with respect to the adjustable pad.

As shown in FIG. 5, certain embodiments of the pad assembly 200 include an attached pointer support platform 220 positioned at one end (e.g., the right end in FIG. 1) of the adjustable pad 204. The pointer support platform 220 supports the mouse 4 or other pointing device. The pointer support platform 220 may be integral with the adjustable pad 204 (e.g., secured to the adjustable pad 204). Alternatively, the pointer support pad 220 may include positioning devices (not shown), such as, for example, tabs to engage slots in the adjustable pad 204, so that the pointer support platform 220 may be temporarily engaged with the adjustable pad 204 and subsequently removed.

In other embodiments, the adjustable pad 204 can be provided without an attached or attachable pointer support platform 220. A user may position a conventional mouse pad proximate to an end of the adjustable pad 204 so that the benefits of the adjustable pad 204 may be utilized in combination with the conventional mouse pad.

It will be understood that in any alternative, the pointer support platform 220 or a conventional mouse pad can also be positioned at the left end of the adjustable pad 204 to accommodate left-handed users and other users wanting the pointing device at that location.

The pad assembly 200 may be used with conventional keyboards without modifying the keyboard. On the other hand, a user may want to have the pad assembly 200 remain in substantially the same position with respect to the keyboard 3 so that the positions of the keys are known with respect to the positions of the user's hands on the adjustable pad 204. FIG. 5 illustrates an embodiment of the pad assembly 200 that includes a positioning device that requires minimal modification of the keyboard 3. In particular, the pad assembly 200 includes a tab 230 that extends generally perpendicularly from the rear edge of the adjustable pad 204. The tab 230 comprises a thin material (e.g., metal or plastic) and is disposed in a plane generally parallel to the supporting surface 2 when the pad assembly is resting on the supporting surface 2. The plane of the tab 230 may be a short distance (e.g., 0.05 inch) above the supporting surface 2.

A rectangular bracket assembly 240 is provided to attach to the underside of a conventional keyboard (e.g., the keyboard 3). The bracket assembly 240 is shaped to have a first attachment portion 242 and a second attachment portion 244 and a middle portion 246. As illustrated, the first and second attachment portions 242, 244 are in a common plane. The middle portion 246 is in a second plane, which is displaced below the common plane by an amount generally corresponding to the thickness of the tab 230. The bracket assembly 240 is positioned on the underside of the keyboard 3 with the boundaries between the attachment portions and the middle portion perpendicular to the front edge of the keyboard. Respective upper surfaces of the attachment portions 242, 244 advantageously are coated with an adhesive (not shown) that secures the upper surfaces to the underside of the keyboard 3 in a conventional manner. It will be appreciated that the surfaces may be advantageously coated with a high-tensile pressure-sensitive adhesive and covered with a peel strip for delivery to a user. The user removes the peel strip just prior to attaching the bracket assembly 240 to the keyboard 3.

When the bracket assembly 240 is secured to the keyboard 3 in the foregoing manner, the middle portion 246 of the bracket assembly 240 and the underside of the keyboard 3 form a cavity into which the tab 230 of the pad assembly 200 can be inserted. The width and the displacement of the middle portion 246 are sized with respect to the tab 230 so that the tab 230 is snugly engaged within the cavity. With the tab 230 engaged in the cavity, the keyboard 3 does not readily move with respect to the pad assembly 200 in response to usual typing movements and forces. On the other hand, the keyboard 3 may be readily disconnected from the pad assembly 200 by applying a force perpendicular to the respective edges of the keyboard 3 and the pad assembly 200 in the plane of the tab 230 to pull the tab 230 out of the cavity.

The upper portion 205 of the adjustable pad 204 is covered with a low friction, durable cover material 250. For example, in a preferred embodiment, the cover material 250 comprises a neoprene material such as, for example, wetsuit material. The cover material 250 is bonded to the curved upper portion 205 using a suitable adhesive material (e.g., epoxy glue or the like) compatible with the neoprene material.

The pointer support platform 220 may also be covered with a suitable cover material 252. For example, the cover material 252 for the pointer support platform 220 may comprise the neoprene wetsuit material discussed above with respect to the cover material 250. Other materials may also be used. In a further alternative, the pointer support platform 220 may not include a cover material. A user can place a commercially available mouse pad of the user's choice on the pointer support platform 220.

FIG. 1 further illustrates a first cradle 260 for a user's left arm, wrist and hand and a second cradle 262 for a user's right arm, wrist and hand. The cradles 260, 262 may comprise metal or molded plastic configured to conform to the palm, wrist and forearm of the user. The two cradles 260, 262 could be configured differently for the user's left and right hands; however, in the illustrated embodiment, the two cradles 260, 262 are substantially identical and are interchangeable. Thus, the following description of the left cradle 260 is also applicable to the right cradle 262.

Figure 4A:
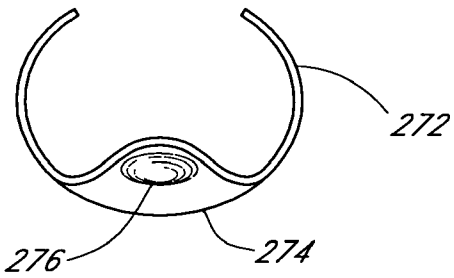
FIG. 4A illustrates an end view of the wrist cradle of FIG. 3 showing the bracelet for securing the cradle to a user's wrist and further showing the raise portion for supporting the user's palm.
Figure 3:
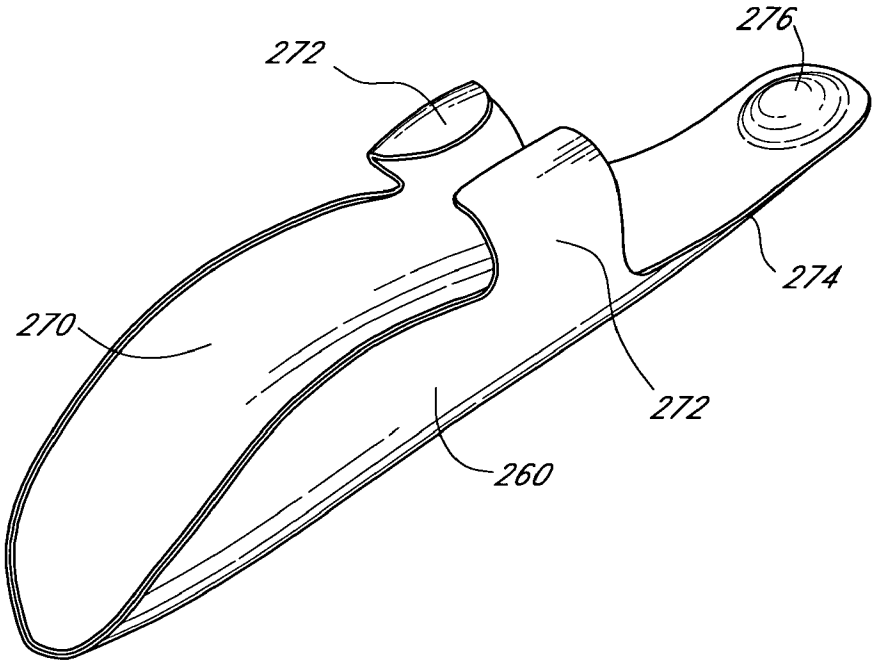
FIG. 3 illustrates a perspective view of an embodiment of the wrist cradle.

As shown in FIGS. 2A, 3 and 4A for the left cradle 260, the user positions the cradle 260 on the lower forearm, wrist and palm of the hand. The cradle 260 comprises a forearm support portion 270, an integral flexible bracelet clip 272 and a palm support 274. The forearm support portion 270 is generally arcuate and is sized to receive the lower forearm of the user. The clip 272 is positioned in a middle region of the cradle 260 where the user's wrist rests in the forearm support portion 270. The palm support 274 extends from the forearm support portion 270 so that the palm support 274 is positioned beneath the user's palm.

As shown in the end view of FIG. 4A, the clip 272 is sized to fit partially around the lowermost end of the user's forearm or the user's wrist to provide a snug, comfortable fit. The clip 272 keeps the cradle 260 in place as the user moves the left hand.

Figure 4B:
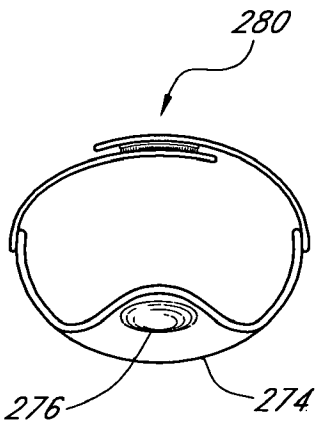
FIG. 4B illustrates an end view of an alternative embodiment of the wrist cradle having a hook and pile fastening system for securing the cradle to a user's wrist.

In an alternative embodiment shown in FIG. 4B, the cradle 260 is attached to the wrist using a hook and pile fastening system (e.g., VELCRO® tape) 280 secured to the sides of the cradle 260. Other fastening systems may also be used.

The palm support 274 has a narrow, spoon-like shape. In particular, the palm support 274 includes a raised portion 276 that is shown more clearly in the end views of FIGS. 4A and 4B. The raised portion 276 extends up into the concave contour of the user's palm to provide additional support for the palm. The width of the palm support 274 is sufficiently narrow that the user's fingers move freely without contacting the palm support 274.

In preferred embodiments, the portions of the cradles 260, 262 in contact with the user's forearms and hands are lined with a material to provide comfortable support for the user. For example, the low-friction neoprene (e.g., wetsuit) material that covers the adjustable pad 204 can also be used to cover the inner portions of the cradles 260, 262.

When the user positions the cradle 260 on the upper portion 205 of the adjustable pad 204, the user's palm and wrist are maintained in a generally horizontal position over the keyboard 3 without requiring the user to exert significant effort to maintain the wrist in a neutral position. The reduced effort reduces strains on the user's arms and shoulders while operating a keyboard.

As further shown in FIG. 2, the cradle 260 generally rests on the highest point of the upper portion 205 of the adjustable pad 204. Because of the curved contour of the upper portion 205, the area of contact between the cradle 260 and the cover material 250 is much smaller than the area would be if the upper portion 205 was flat. The combination of the low-friction cover material 250 and the small area of contact results in very low friction between the cradle 260 and the cover material 250. Thus, even with the weight of the user's arm and hand resting on the upper portion 205, the user is able to easily move the cradle 260 horizontally on the upper portion 205 (both toward and away from the keyboard 3 and to the left and the right). As illustrated in FIG. 1, the length of the adjustable pad 204 is selected so that the user can move the palm support 274 of the right cradle 262 over the pointer support platform 220 and continue to have full support while using the mouse 4 or other pointing device.

By placing the cradles 260, 262 on the adjustable pad 204 as described above, the user's lower arms, wrists and hands are supported to substantially reduce strains to the user's arms and shoulders during the operation of the keyboard 3. Furthermore, the low-friction interface between the cradles 260, 262 and the cover material 250 allows the user to effortlessly move the hands over the keyboard.

Although described above with respect to a keyboard and a pointing device, the foregoing embodiments can also be advantageously used when performing other repetitive tasks that require a user's hands to be extended.

One skilled in art will appreciate that the foregoing embodiment is illustrative of the present invention. The present invention can be advantageously incorporated into alternative embodiments while remaining within the spirit and scope of the present invention, as defined by the appended claims.

What is claimed is:

1. A system for supporting the forearms and hands of a user performing repetitive tasks, comprising:

a support pad having a low-friction upper surface; and first and second cradles movable vertically and horizontally with respect to the upper surface of the support pad, each of the first and second cradles comprising:

a first portion to support the lower portion of the forearm of a user when the first potion is positioned upon the upper surface of the support pad;

a second portion to support the hand of the user; and a retaining device to attach the cradle to the lower forearm of the user.

2. The system as defined in claim 1, wherein the low-friction upper surface comprises neoprene material.

3. The system as defined in claim 1, wherein the support pad has a bottom surface, and wherein the height of the upper surface with respect to the bottom surface is adjustable.

4. The system as defined in claim 3, wherein the height is adjustable by rotating at least one wheel threaded onto a stud.

5. The system as defined in claim 1, wherein the retaining device comprises a bracelet fixed to the first portion.

6. The system as defined in claim 1, wherein the retaining device comprises a hook and pile fastening system.

7. The system as defined in claim 1, wherein the second portion includes a raised portion positioned to engage the palm of a user.

8. A method for reducing strains on the arms and shoulders of a user performing repetitive tasks such as typing and data entry, comprising:

positioning a support pad proximate a keyboard and generally in parallel to the front edge of the keyboard, the support pad having an upper surface, the upper surface comprising a low-friction material:

attaching a cradle to each of the user's lower forearms and hands using a retaining device, the cradle having a forearm support portion and a hand support portion, the cradle being independent of and freely movable horizontally and vertically with respect to the upper surface of the support pad; and positioning the forearm support portion of each cradle on the upper surface of the support pad with the hand support portions directed toward the keyboard, the cradles supporting at least a portion of the weight of the user's arms and hands while the user performs the repetitive tasks.

9. A system for supporting the forearms and hands of a user performing repetitive tasks, comprising:

a support device having a curved upper surface, at least the upper surface comprising a low-friction material; and first and second cradles independently movable vertically and horizontally with respect to the upper surface of the support device, each of the first and second cradles comprising:

a first portion to support the lower portion of the forearm of a user, the first portion having a curved lower surface that has a small area of contact with the curved upper surface of the support device when the first portion is positioned upon the upper surface of the support device;

a second portion to support the hand of the user; and a retaining device to attach the cradle to the lower forearm of the user.

* * * * *